US008729802B2

(12) United States Patent
Gerhard et al.

(10) Patent No.: US 8,729,802 B2
(45) Date of Patent: May 20, 2014

(54) BURNER WITH REDUCED HEIGHT AND METHOD OF MANUFACTURING A BURNER

(75) Inventors: Markus Gerhard, Aachen (DE); Lars Dabringhausen, Baesweiler (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/522,345

(22) PCT Filed: Jan. 19, 2011

(86) PCT No.: PCT/IB2011/050225

§ 371 (c)(1),
(2), (4) Date: Jul. 16, 2012

(87) PCT Pub. No.: WO2011/092608

PCT Pub. Date: Aug. 4, 2011

(65) Prior Publication Data

US 2012/0293066 A1 Nov. 22, 2012

(30) Foreign Application Priority Data

Jan. 28, 2010 (EP) ..... 10151861

(51) Int. Cl.
*H01J 17/16* (2012.01)
*H01J 61/30* (2006.01)

(52) U.S. Cl.
USPC ..... 313/634; 313/623

(58) Field of Classification Search
USPC ..... 313/25–27, 111–117, 317, 313/318.01–318.09, 483–493, 567–577, 313/623, 627–643; 439/615, 739; 445/22, 445/24, 26, 29
See application file for complete search history.

(56) References Cited

U.S. PATENT DOCUMENTS

| | | | | |
|---|---|---|---|---|
| 5,726,532 | A * | 3/1998 | Wittig et al. | 313/636 |
| 5,889,360 | A * | 3/1999 | Frey et al. | 313/318.01 |
| 6,731,076 | B1 | 5/2004 | Gerhard | |
| 7,161,302 | B2 | 1/2007 | Myojo | |
| 2007/0222387 | A1 * | 9/2007 | Bittmann | 313/631 |

FOREIGN PATENT DOCUMENTS

| | | | |
|---|---|---|---|
| DE | 19640666 | A1 | 4/1998 |
| DE | 102005041719 | A1 | 3/2007 |
| EP | 0921553 | A2 | 6/1999 |
| EP | 0930635 | A2 | 7/1999 |

(Continued)

OTHER PUBLICATIONS

KR2005103858A, "Flat Fluorescent Lamp Having Mixed Electrodes for Forming Zigzag Type Discharge Channel" Abstract Only, 2005.

*Primary Examiner* — Donald Raleigh

(57) ABSTRACT

It is provided a burner for automotive lamps, particularly HID lamps, comprising a discharge vessel for generating light by means of a discharge arc. A glass body for protecting the discharge vessel comprises a shaft for being inserted into a socket. The shaft comprises at least one insulation pocket for receiving a rib of the socket and for insulating the first electrode outside the glass body. Due to the insulation pocket the glass body may provide an umbrella-like dielectric increasing the minimum necessary way for a high voltage discharge arc to the uncovered part of the first electrode at the proximal end of the shaft. Due to the improved insulation effect by means of the insulation pocket, the height of the shaft of the glass body may be significantly reduced leading to a reduced height of the burner without impairing the insulation of the burner.

12 Claims, 4 Drawing Sheets

(56) References Cited

FOREIGN PATENT DOCUMENTS

| | | | |
|---|---|---|---|
| EP | 1033749 | A2 | 9/2000 |
| EP | 1524683 | A2 | 4/2005 |
| EP | 1538657 | A2 | 6/2005 |
| WO | 2009050869 | A1 | 4/2009 |

* cited by examiner

BURNER WITH REDUCED HEIGHT AND METHOD OF MANUFACTURING A BURNER

FIELD OF THE INVENTION

The invention relates to the field of burners, which can be particularly used as light source of an HID lamp for an automotive headlight, as well as a method of manufacturing such kind of a burner.

BACKGROUND OF THE INVENTION

A known HID lamp 10 as illustrated in FIG. 1 for use in an automotive headlight comprises a burner 12 with a discharge vessel 14 where light is generated by means of a discharge arc provided between the tips of a first electrode 16 and a second electrode 18 both terminating in the discharge vessel 14. The discharge vessel 14 is protected by a glass body 20. The glass body 20 of the burner 12 comprises a shaft 22 which is inserted into a socket 24. The first electrode 16 is led out of the proximal end of the shaft 22 in axial direction. Due to the shaft 22 a sufficient insulation is provided preventing a high voltage discharge between the first electrode 16 at the proximal end of the shaft 22 and the second electrode 18 which is also led into the socket 24 (not illustrated). A comparable burner is known from U.S. Pat. No. 6,731,076 B1.

There is a permanent need of optimizing the required building space of automotive headlights.

SUMMARY OF THE INVENTION

It is an object of the invention enabling a further optimization of the required building space of an automotive headlight. It is particularly an object of the invention providing a burner for an automotive lamp, particularly a HID lamp, by means of which the total height of the automotive lamp can be reduced. Particularly preferred it is an object of the invention of providing a burner with reduced height, preferably without impairing the insulation of the burner.

This object is achieved by a burner for automotive lamps, particularly HID lamps, comprising a discharge vessel for generating light by means of a discharge arc, a first electrode terminating in the discharge vessel, a second electrode terminating in the discharge vessel for generating the discharge arc in cooperation with the first electrode, and a glass body for protecting the discharge vessel, wherein the glass body comprises a shaft for being inserted into a socket, wherein the first electrode is led through the shaft out of the glass body in a proximal direction and the second electrode is led spaced to the first electrode outside the shaft in proximal direction, wherein the shaft comprises at least one insulation pocket for receiving a rib of the socket and for insulating the first electrode outside the glass body.

Due to the insulation pocket the glass body may provide an umbrella-like dielectric increasing the minimum necessary way for a high voltage discharge arc between the uncovered part of the first electrode at the proximal end of the shaft and the second electrode or other conductive parts. The insulation pocket provided by the material of the glass body may provide a labyrinth sealing particularly in combination with a corresponding rip of the socket, wherein the insulation effect by this labyrinth sealing is significantly increased due to the better dielectric coefficient of the material of the glass body in comparison to the usually plastic material of the socket, like PPS (polyphenylene sulfide, $(SC_6H_4)_n$). Particularly material of the glass body which is part of a wall of the insulation pocket is provided between the uncovered part of the first electrode and the nearest conductive part. Due to the improved insulation effect by means of the insulation pocket the height of the shaft of the glass body may be significantly reduced leading to a reduced height of the burner without impairing the insulation of the burner. The total height of an automotive lamp comprising this burner can be reduced which in turn enables a further optimization of the required building space of the automotive headlight. Particularly a reduction of the required building space of the automotive headlight, particularly in driving direction, is enabled. Outgassed components, particularly components of the plastic material of the socket, can be collected by means of the insulation pocket. The risk is reduced that outgassed material from inside the socket may condense at the glass body of the burner near the light source. This improves the optical performance of the lamp over the life-time of the lamp. In addition outgassed components may condense inside the insulation pocket even increasing the insulation effect over the life time of the burner. The insulation performance of the burner may increase by aging effects. Due to the increased insulation effect it is particularly possible arranging the socket inside a metal housing for reducing EMI emissions and/or for a further reduced escape of outgassed components. Further additional insulation means can be saved leading to a cost reduction. Further the insulation pocket may be one-piece with the glass body. A particularly provided rib for being inserted into the insulation pocket may be one-piece with the socket. Since the necessary insulation may be provided by a corresponding design of existing parts the number of assembling parts is not increased or may even be reduced. Particularly the design of the glass body and/or the design of the socket may be provided during one already planed manufacturing step. For instance the insulation pocket may be formed by means of a stamp pressed into the glass body, while the glass body is heated and ductile by means of a rolling process for sealing the first electrode to the glass body in a pinched neck region, from which the shaft may protrude in mainly proximal direction. The manufacturing time of the burner may not be increased or even shortened.

A HID lamp is a high density discharge lamp comprising a burner with a discharge vessel which is particularly adapted for operating at a pressure up to 1 MPa, wherein the discharge vessel may be filled with a noble gas like xenon, krypton and/or neon and may comprise a halogen and/or metal halide and/or mercury. When the burner is received by the socket and the socket is placed onto a ground such that the burner points mainly in opposite direction of gravity direction, it is understood that the proximal direction of the burner is aligned in gravity direction and the distal direction of the burner is aligned against gravity direction. The glass body comprises mainly $SiO_2$ or even consists of $SiO_2$ with possible impurities of 10 to 1000 ppm (expressed in mol).

Particularly the insulation pocket is formed as a ring-like recess. Since the design of the insulation pocket in radial and/or axial direction is mainly constant, the insulation effect between the first electrode and the second electrode or other conductive parts is independent from the angular position of the burner in circumferential direction. This facilitates providing a correct alignment of the burner with respect to reference features of the socket like three reference protrusions pointing in distal direction.

Preferably the shaft comprises a plurality of insulation pockets particularly arranged one after the other in radial direction. Due to the several insulation pockets a corresponding number of ribs may be inserted into the respective insulation pocket. This leads to a labyrinth sealing comprising a correspondingly increased minimum necessary high voltage discharge way. The insulation effect may be increased particularly due to the increased volume of dielectric material between the uncovered part of the first electrode and the nearest conductive material. The uncovered part of the electrode is not covered by the glass body and particularly protrudes from the proximal end of the shaft of the glass body.

Further preferred the shaft comprises a mainly radial protruding lug, wherein at least one finger is provided protruding from the lug in mainly proximal direction for forming the insulation pocket. Particularly the finger comprises a length $l_F$ in axial direction of 2.0 mm≤$l_F$≤14.0 mm, particularly 3.0 mm≤$l_F$≤12.0 mm, preferably 4.0 mm≤$l_F$≤10.0 mm and most preferred 4.5 mm≤$l_F$≤5.0 mm or 5.0 mm≤$l_F$≤7.0 mm or 7.0 mm≤$l_F$≤9.0 mm. The insulation pocket may be mainly U-shaped in cross sectional view, wherein the walls of the "U" may by provided by the finger for the first arm of the "U", by the lug for the bottom wall of the "U" and by the residual shaft for the second arm of the "U". A second insulation pocket and/or further insulation pockets may be provided by a corresponding numbers of fingers protruding from a further lug and/or particularly protruding from the same lug. The length $l_F$ of the finger is particularly chosen in dependency of the number of insulation pockets. In the case of a low number of insulation pockets, particularly only one insulation pocket, a longer length $l_F$ may be chosen, preferably longer than the length of the residual shaft, so that the finger protrudes farther in proximal direction than the residual shaft. In the case of a medium number of insulation pockets, particularly two insulation pockets, a medium length $l_F$ may be chosen, preferably mainly as long as the residual shaft, so that the finger and the residual shaft terminates at mainly the same level. In the case of a higher number of insulation pockets, particularly more than three insulation pockets, a shorter length $l_F$ may be chosen, preferably shorter than the length of the residual shaft, so that the residual shaft protrudes farther in proximal direction than the finger. This gives an increased flexibility for arranging electronic components, for instance a starter circuit for the burner, inside the socket without impairing the insulation of the burner. The increased flexibility for arranging different components of the lamp enables further possibilities for optimizing the required building space.

Preferably the shaft comprises a length $l_S$ in axial direction of 2.0 mm≤$l_S$≤10.0 mm, particularly 3.0 mm≤$l_S$≤8.0 mm, preferably 4.0 mm≤$l_S$≤6.0 mm and most preferred 4.5 mm≤$l_S$≤5.5 mm. Due to the insulation pocket a significantly reduced shaft length $l_S$ is possible without impairing the insulation of the burner. It is possible to reduce the length of the burner particularly by mainly 8 mm±2 mm in comparison to a known burner without running into mayor problems of arranging electronic components in the socket of the lamp.

Particularly the glass body comprises a pinched neck, where the glass body is pinched by a sealing process, particularly by rolling, and the shaft protrudes from the pinched neck in mainly proximal direction, wherein the pinched neck comprises a length $l_N$ in axial direction of particularly 3.0 mm≤$l_N$≤8.0 mm, preferably 3.5 mm≤$l_S$≤6.0 mm and most preferred 4.0 mm≤$l_S$≤5.0 mm. A sufficient sealing of the glass body can be provided by an easily to perform mechanical sealing process. At the same time only a comparatively small area is needed for the pinched neck performed by the sealing process. Further the sealing of the glass body and the forming of the insulation pocket may by performed at different parts of the glass body and may be arranged axially spaced to each other. It is understood that the area of the glass body used for the pinched neck is not part of the shaft, which is particularly adapted and suitable formed for being inserted into a corresponding opening of the socket of the lamp. The shaft is preferably cylinder-like formed, wherein the pinched neck may be formed elliptic in cross sectional view or may comprise mainly flat parts at its outer surface.

The invention further relates to a lamp, particularly HID lamp for automotive headlights, comprising a burner, which can be designed as previously described, inserted into a socket made from an insulating material, particularly PPS, wherein the socket comprises at least on rib inserted into a corresponding insulation pocket of the burner. Due to the insulation pocket the glass body may provide an umbrella-like dielectric increasing the minimum necessary way for a high voltage discharge arc between the uncovered part of the first electrode at the proximal end of the shaft and the second electrode or other conductive parts. Due to the improved insulation effect by means of the insulation pocket the height of shaft of the glass body may be significantly reduced leading to a reduced height of the burner and thus to a reduced height of the lamp without impairing the insulation of the lamp. The total height of an automotive HID lamp can be reduced which in turn enables a further optimization of the required building space of the automotive headlight. Particularly a reduction of the required building space of the automotive headlight, particularly in driving direction, is enabled. The lamp may be further designed as described with respect to the above mentioned burner.

Preferably at least one metal fixation element, particularly metal lug, is connected to the socket, wherein the fixation element is connected to the burner, particularly via a metal collar clamped to the burner, and a slit is provided between the glass body and the rib, wherein a minimum discharge way s starting at the first electrode at the end of the shaft along the slit to the fixation element is 8.0 mm≤s≤50.0 mm, particularly 10.0 mm≤s≤40.0 mm, preferably 12.0 mm≤s≤30.0 mm and most preferred 15.0 mm≤s≤20.0 mm. It is used the insight that the second electrode may be led through a ceramic bush providing an increased insulation, so that a risk for a high voltage discharge arc may be mainly given between the first electrode and the metal fixation element, which may be connected to ground. Further it is possible providing a significantly long high voltage discharge way between the first electrode and the nearest conductive part, wherein at the same time a comparatively low length of the shaft of the glass body is given. The slit between the glass body and the rib may occur due to tolerances or by providing a clearance fit between the glass body and the rib. But it is also possible that the rib is pressed into the insulation pocket, so that the slit is provided between the phase boundaries between the glass body and the rib.

Particularly preferred the slit is at least partially filled by an insulation plug, particularly comprising mainly silicon, at least at one position, wherein the insulation plug covers the whole cross section of the slit in the direction from the first electrode to the fixation element. The insulation plug is particularly a thermosetting fluid, which may fill the whole cross section of the slit and becomes solid later on. Since the insulation plug may provide a better insulation than air, the insulation effect is increased.

Particularly the socket comprises a top surface pointing in distal direction and a bottom surface pointing in proximal direction, wherein a distance d between the top surface and the bottom surface is 8.0 mm≤d≤22.0 mm, particularly 10.0 mm≤d≤20.0 mm, preferably 12.0 mm≤d≤18.0 mm and most preferred 14.0 mm≤d≤16.0 mm. Due to the insulation pocket a significantly reduced shaft length $l_S$ is possible without impairing the insulation of the burner. It is possible to reduce the length of the burner particularly by mainly 8 mm±2 mm in comparison to a known burner without running into mayor problems of arranging electronic components in the socket of the lamp. In the case that the top surface comprises reference protrusions pointing in distal direction the distance d is measured between the distal end of the reference protrusion and the proximal end of the bottom surface. The reference protrusions, particularly three reference protrusions, may be provided for aligning the burner with respect to the reference protrusions during connecting the burner to the socket. By means of the reference protrusions the light source of the burner can be exactly positioned with respect to the reference protrusions during the connecting, wherein the correct alignment can be monitored by optical methods. This enables in turn an exact alignment of the light source of the burner with respect to a reflector of an automotive headlight after assembling the automotive lamp within the headlight.

The invention further relates to an automotive headlight comprising a burner, which can be designed as previously described, and/or a lamp, which can be designed as previously described, connected to a reflector housing. Due to the insulation pocket the glass body may provide an umbrella-like dielectric increasing the minimum necessary way for a high voltage discharge arc between the uncovered part of the first electrode at the proximal end of the shaft and the second electrode or other conductive parts. Due to the improved insulation effect by means of the insulation pocket the height of the shaft of the glass body may be significantly reduced leading to a reduced height of the burner and thus to a reduced height of the lamp without impairing the insulation of the lamp. The total height of an automotive HID lamp can be reduced which in turn enables a further optimization of the required building space of the automotive headlight. Particularly a reduction of the required building space of the automotive headlight, particularly in driving direction, is enabled. The lamp may be further designed as described with respect to the above mentioned burner and/or with respect to the above mentioned lamp.

The invention further relates to a method of manufacturing a burner, which can be particularly designed as previously described, for automotive lamps, comprising the steps of providing a preformed glass body comprising a discharge vessel for generating light by means of a discharge arc, a first electrode terminating in the discharge vessel, and a second electrode terminating in the discharge vessel for generating the discharge arc in cooperation with the first electrode; sealing the first electrode with the glass body, particularly by rolling, and forming into the glass body at least one insulation pocket for receiving a rib of the socket and for insulating the first electrode outside the glass body. Due to the insulation pocket the glass body may provide an umbrella-like dielectric increasing the minimum necessary way for a high voltage discharge arc between the uncovered part of the first electrode at the proximal end of the shaft and the second electrode or other conductive parts. Due to the improved insulation effect by means of the insulation pocket the height of the shaft of the glass body may be significantly reduced leading to a reduced height of the burner and thus to a reduced height of the lamp without impairing the insulation of the lamp. The total height of an automotive HID lamp can be reduced which in turn enables a further optimization of the required building space of the automotive headlight. Particularly a reduction of the required building space of the automotive headlight, particularly in driving direction, is enabled. The manufacture may be performed fast and without an increased number of different machines leading to a facilitated manufacture of the burner, the corresponding lamp and/or the corresponding automotive headlight. The method may be further designed as described with respect to the above mentioned burner and/or with respect to the above mentioned lamp and/or with respect to the above mentioned automotive headlight.

Particularly the at least one insulation pocket is formed by means of a rolling process. It is possible to use the same manufacturing process for sealing the glass body as well as for forming the insulation pocket.

Preferably the sealing step and the forming step are carried our simultaneously. It is possible to use the heat provided during the sealing step for facilitating the forming step and vice versa. Although the design of the burner comprises additional parts the manufacturing time may be not increased. It is particularly possible even reducing the manufacturing time due to the increased heat generation by simultaneously performing the sealing step and the forming step.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
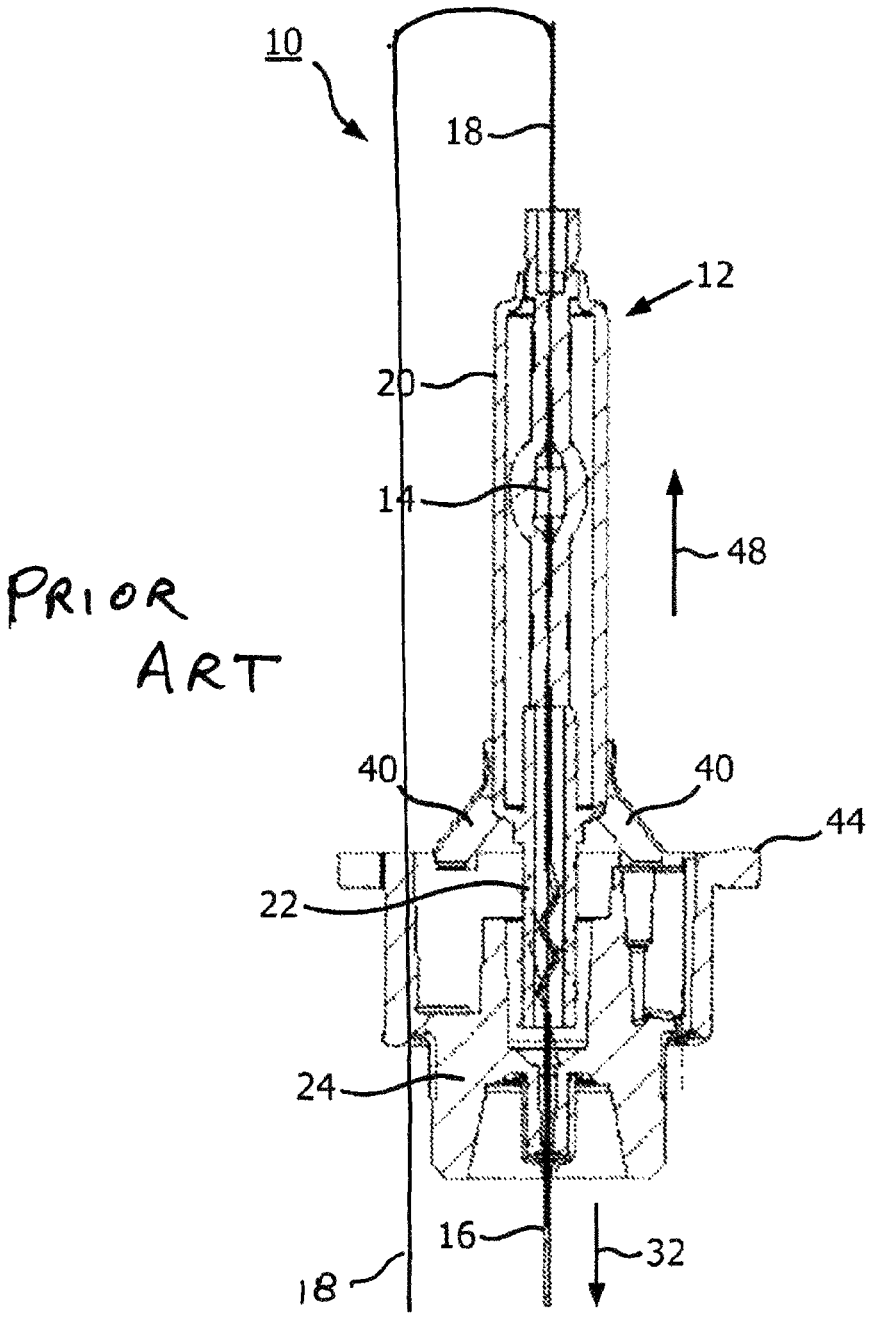
FIG. 1 is a schematic cross sectional side view of a lamp according to the state of the art.
Figure 2:
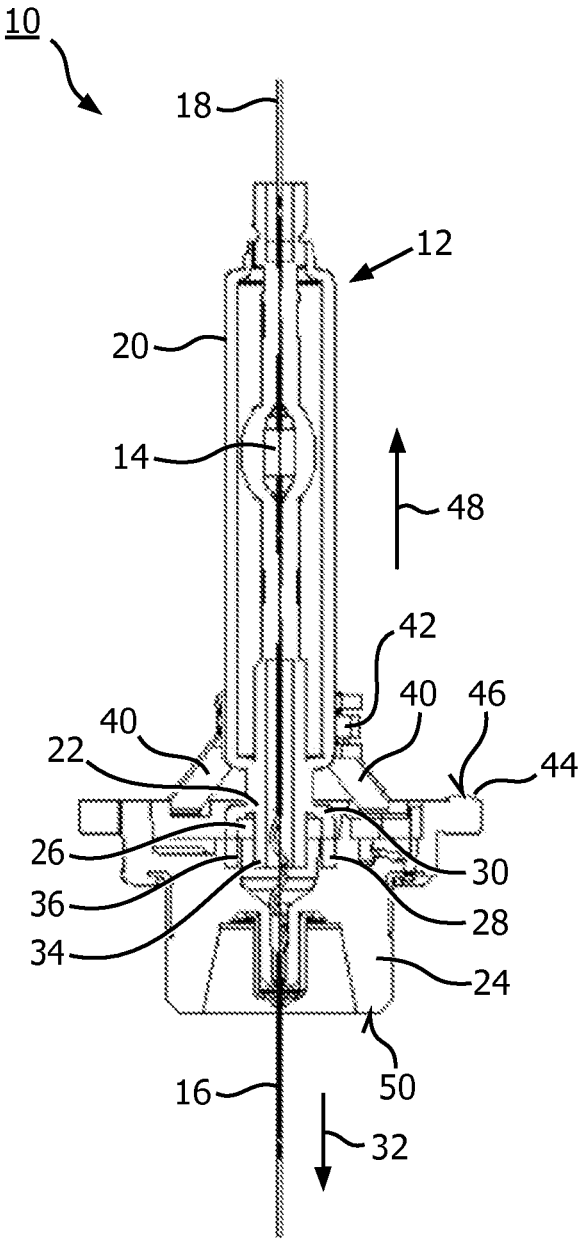
FIG. 2 is a schematic cross sectional side view of a lamp according to the invention in a first embodiment.

The lamp 10, particularly automotive HID lamp, as illustrated in FIG. 2 corresponds mainly to the know lamp 10 as illustrated in FIG. 1, wherein the lamp of FIG. 2 is designed shorter than the lamp 10 of FIG. 1. In contrast to the burner 12 illustrated in FIG. 1 the burner 12 illustrated in FIG. 2 comprises a ring-like insulation pocket 26 formed by a finger 28 protruding from a lug 30 in proximal direction 32, wherein the lug 30 protrudes in radial direction from a remaining shaft 34. A rib 36 of the socket 24 protrudes into the insulation pocket 26 providing a zigzag like slit 38 between the rib 36 and the shaft 22 of the glass body 20. Due to the insulation pocket 26 a sufficient insulation is provided between the part of the first electrode 16 not covered by the glass body 20 and a metal fixation element 40, which may be connected to ground. The fixation element 40 is designed as a metal band fixed with the socket 24 and connected to the burner 12 via a metal collar 42 clamped to the glass body 20. The fixation element 40 may be connected to the metal collar 42 by welding particularly laser welding. Before fixing the burner 12 to the socket 24 via the collar 42 and the fixation element 40 the burner 12 can be correctly aligned by optical methods using particularly three reference protrusions 44 provided by the socket 24. A distance between a top surface 46 of the socket 24 pointing in distal direction 48 and a bottom surface 50 of the socket 24 pointing in proximal direction 32 is reduced compared to the lamp 10 illustrated in FIG. 1

Figure 3:
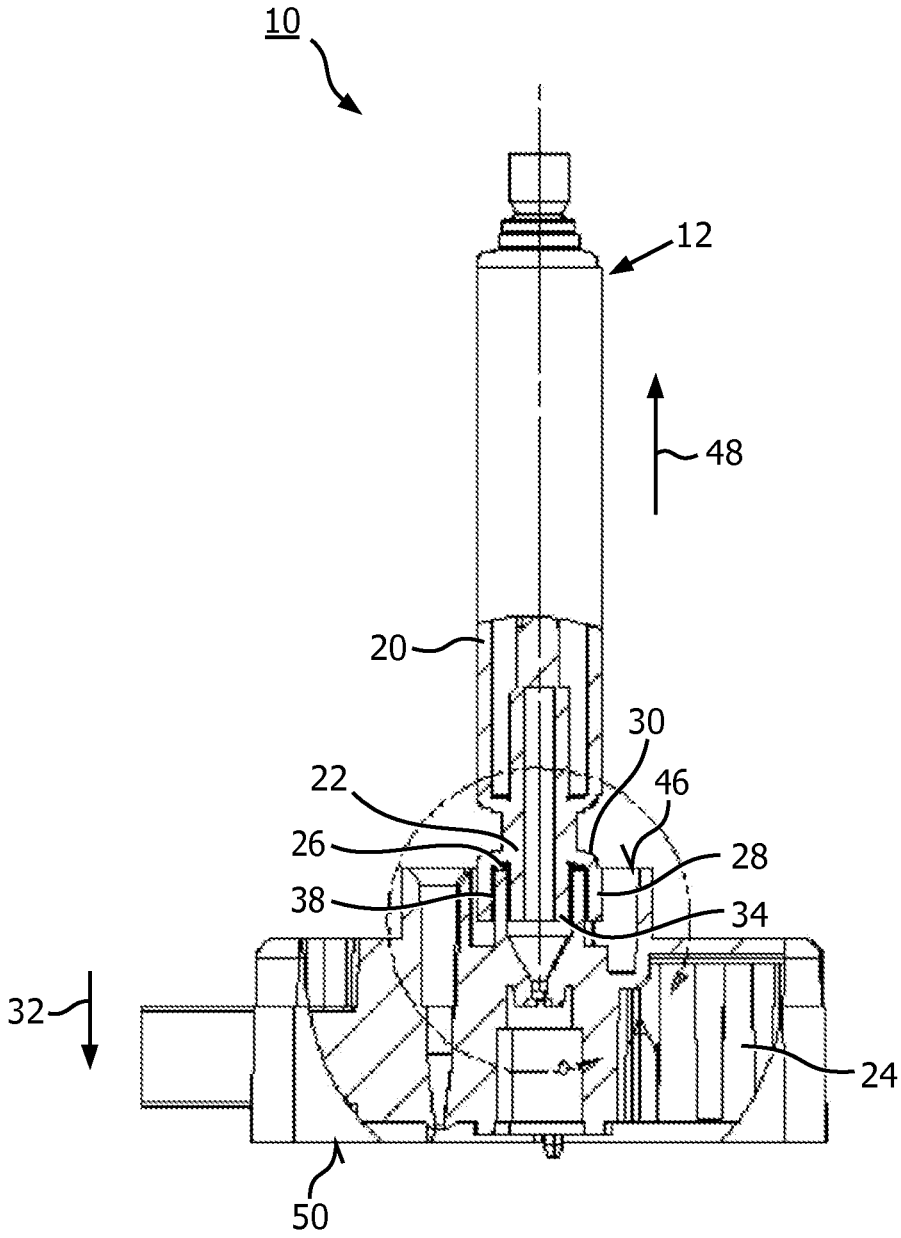
FIG. 3 is a schematic simplified cross sectional side view of a lamp according to the invention in a second embodiment.
Figure 4:
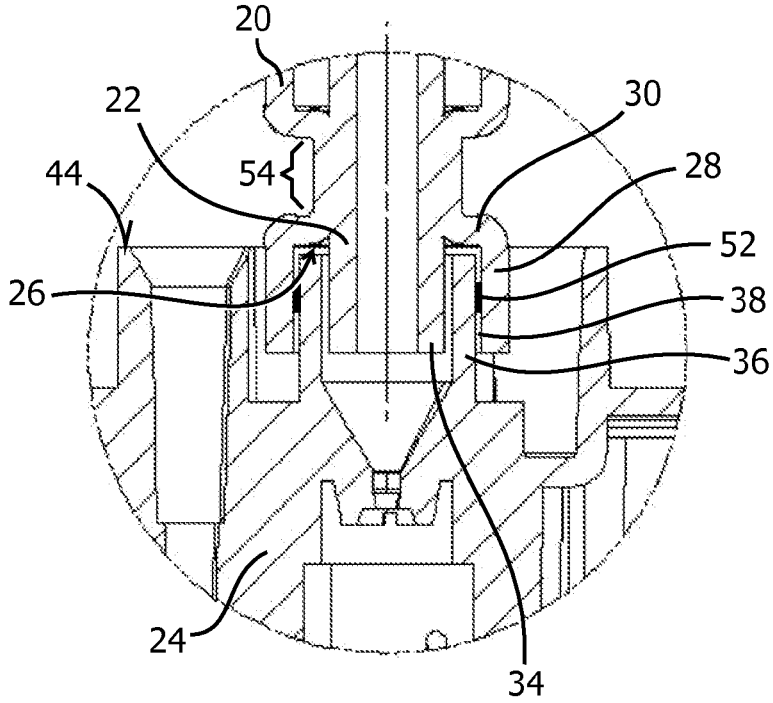
FIG. 4 is a schematic detailed view of the lamp illustrated in FIG. 3.

The lamp 10 illustrated in FIG. 3 comprises a burner 12 of mainly the same design like the lamp 10 illustrated in FIG. 2. The lamp 10 illustrated in FIG. 3 comprises a socket 24 in line with a different standard for automotive lamps. As illustrated in FIG. 4 a ring-like insulation plug 52 covers the whole cross section of the slit 38 in the direction from the first electrode 16 outwards. The insulation plug 52 may comprise mainly silicon. The glass body 20 comprises a pinched neck 54, where the glass body 20 is sealed. The pinched neck 54 is provided between the insulation pocket 26 and a broadened part of the glass body 20.

Figure 5:
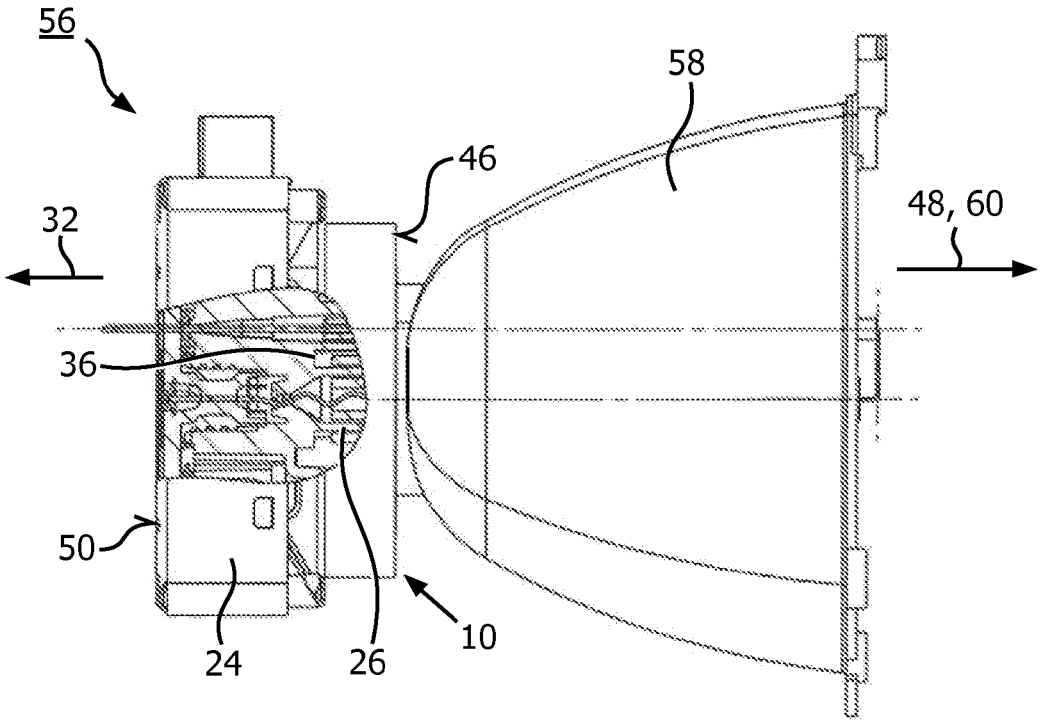
FIG. 5 is a schematic cross sectional side view of an automotive headlight comprising the lamp illustrated in FIG. 3.

The automotive headlight 56 as illustrated in FIG. 5 comprises a reflector housing 58 connected to the lamp 10. Due to the reduced height of the lamp 10 the height of the headlight 56 is also reduced particularly in driving direction 60.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein a plurality of insulation pockets 26 is provided. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. Burner for automotive lamps, particularly HID lamps, comprising a discharge vessel for generating light by means of a discharge arc, a first electrode terminating in the discharge vessel, a second electrode terminating in the discharge vessel for generating the discharge arc in cooperation with the first electrode, and a glass body for protecting the discharge vessel, wherein the glass body comprises a shaft for being inserted into a socket, wherein the first electrode is led through the shaft out of the glass body in a proximal direction and the second electrode is led spaced to the first electrode outside the shaft in the proximal direction, wherein the shaft comprises at least one insulation pocket for receiving a rib of the socket and for insulating the first electrode outside the glass body; and, wherein the shaft comprises a plurality of insulation pockets particularly arranged one after the other in radial direction.

2. Lamp, particularly HID lamp for automotive headlights, comprising a burners; the lamp capable of being inserted into a socket made from an insulating material, wherein the socket comprises at least one rib inserted into a corresponding insulation pocket of the burner; and wherein the socket comprises a top surface pointing in distal direction and a bottom surface pointing in proximal direction, wherein a distance d between the top surface and the bottom surface is 8.0 mm≤d≤22.0 mm; and, wherein said burner comprises:

a discharge vessel for generating light by means of a discharge arc, a first electrode terminating in the discharge vessel, a second electrode terminating in the discharge vessel for generating the discharge arc in cooperation with the first electrode, and a glass body for protecting the discharge vessel, wherein the glass body comprises a shaft for being inserted into the socket, wherein the first electrode is led through the shaft out of the glass body in a proximal direction and the second electrode is led spaced to the first electrode outside the shaft in the proximal direction, wherein the shaft comprises at least one insulation pocket for receiving the rib of the socket and for insulating the first electrode outside the glass body.

3. Burner according to claim 2 wherein the shaft comprises a mainly radial protruding lug, wherein at least one finger is provided protruding from the lug in mainly proximal direction for forming the insulation pocket.

4. Burner according to claim 3 wherein the finger comprises a length $l_F$ in axial direction of 2.0 mm≤$l_F$≤14.0 mm.

5. Burner according to claim 2 wherein the shaft comprises a length $l_S$ in axial direction of 2.0 mm≤$l_S$≤10.0 mm.

6. Burner according to claim 2 wherein the glass body comprises a pinched neck, where the glass body is pinched by a sealing process, and the shaft protrudes from the pinched neck in mainly proximal direction, wherein the pinched neck comprises a length $l_N$ in axial direction of 3.0 mm≤$l_N$≤8.0 mm.

7. Burner according to claim 2 wherein the insulation pocket is formed as a ring-like recess.

8. Lamp according to claim 2 wherein at least one metal fixation element, particularly metal lug, is connected to the socket, wherein the fixation element is connected to the burner, via a metal collar clamped to the burner, and a slit is provided between the glass body and the rib, wherein a minimum discharge way starting at the first electrode at the end of the shaft along the slit to the fixation element is 8.0 mm≤s≤50.0 mm.

9. Lamp according to claim 8 wherein the slit is at least partially filled by an insulation plug, comprising mainly silicon, at least at one position, wherein the insulation plug covers the whole cross section of the slit in the direction from the first electrode to the fixation element.

10. Automotive headlight comprising a burner according to claim 2 connected to a reflector housing.

11. Method of manufacturing a burner, according to claim 1, for automotive lamps, comprising the steps of:

providing a preformed glass body comprising a discharge vessel for generating light by means of a discharge arc, a first electrode terminating in the discharge vessel, and a second electrode terminating in the discharge vessel for generating the discharge arc in cooperation with the first electrode;

sealing the first electrode with the glass body, and forming into the glass body at least one insulation pocket for receiving a rib of the socket and for insulating the first electrode outside the glass body; and, wherein the at least one insulation pocket is formed by means of a rolling process.

12. Method according to claim 11 wherein the sealing step and the forming step are carried out simultaneously by a rolling process.

* * * * *